US005846345A

United States Patent [19]

Naka et al.

[11] Patent Number: 5,846,345

[45] Date of Patent: Dec. 8, 1998

[54] INTERMETALLIC ALLOY BASED ON TITANIUM ALUMINIDE FOR CASTING

[75] Inventors: Shigehisa Naka, Jouy en Josas; Marc Thomas, Plessis-Robinson; Agnès Bachelier-Locq, Chatenay-Malabry; Tasadduq Khan, Jouy en Josas, all of France

[73] Assignee: Office National D'Etudes et de Recherches Aerospatiales, Chatillon, France

[21] Appl. No.: 622,668

[22] Filed: Mar. 26, 1996

[51] Int. Cl.[6] ..... C22C 14/00

[52] U.S. Cl. ..... 148/421; 420/418

[58] Field of Search ..... 148/421; 420/418

[56] References Cited

U.S. PATENT DOCUMENTS 4,783,329 11/1988 Maeland et al. ..... 148/421
5,041,262 8/1991 Gigliotti ..... 420/419

*Primary Examiner*—John Sheehan
*Attorney, Agent, or Firm*—Hoffmann & Baron, LLP

[57] ABSTRACT

In an alloy having a Ti/Al ratio close to 52/48, good castability, by virtue of initial solidification in the β phase, together with a sufficiently low density and a good oxidation resistance are obtained by introducing approximately 2 atom. % of rhenium and/or tungsten. These alloys can be used especially for the production of aeronautical turbomachine components.

8 Claims, 3 Drawing Sheets

INTERMETALLIC ALLOY BASED ON TITANIUM ALUMINIDE FOR CASTING

The invention relates to an intermetallic alloy based on titanium aluminide for the production of castings.

The conversion, by casting, of intermetallic alloys derived from γ titanium aluminide (TiAl) is of interest for the production of aeronautical turbo machine components. Casting is in fact generally less expensive than other shaping processes. Moreover, it has the advantage of preserving, in principle, the hot mechanical strength of the cast components because the size of the metallurgical grains obtained is relatively large.

Although appreciable differences have been observed in the castability of these alloys, that is to say their ability to form castings which are of good quality and guarantee reliability and reproducibility of the mechanical behavior, no data is available which allows these differences to be explained, especially in connection with the behavior of the alloys as they solidify and/or with their chemical composition.

In order to develop alloy compositions suitable for casting, the inventors carried out a study on the effect of various refractory addition elements on castability. They analyzed many TiAl-based alloys in which from 2 to 10% of the atoms consisted of one or more of the addition elements Nb, Ta, Cr, Mo, W, Fe and Re and, in particular, examined their microstructures both in the as-cast state and after heat treatments. They thus came to the conclusion that the solidification process constitutes an important parameter for the quality of the castings. The various alloys examined may in fact be classified into two categories, in which an α phase of hexagonal crystal structure and a β phase of body-centered cubic structure are initially formed, respectively.

In the case of α-phase solidification, the initial crystals of this phase tend to form columnar grains along the thermal gradient during solidification and the columnar nature of the as-cast microstructure is often extremely pronounced because of the preferred crystal growth parallel to the c-axis which is unique in the hexagonal α structure. Moreover, all the γ-phase lamellae, which precipitate in each of the columnar grains during subsequent cooling to form the so-called $\gamma+\alpha_2$ lamellar structure, are oriented perpendicular to the c-axis of the hexagonal phase because of the $(0001)_\alpha//(111)_\gamma$ and $<11\bar{2}0>_\alpha//<1\bar{1}0>_\gamma$ orientation relationship inherent in the implied phase transformation mechanism.

This phase transformation mechanism makes it possible to explain certain serious difficulties encountered when producing cast products from the alloys in question, especially various defects such as cracks of thermal origin and porosity introduced into the intercolumnar zone, as well as a highly anisotropic character (texture) in the products, which risk adversely affecting their mechanical performance. Most alloys developed to date, the best known being a $Ti_{48}Al_{48}Cr_2Nb_2$ grade described in U.S. Pat. No. 4,879,092, belong to this category of alloys which essentially solidify in a form and, when these alloys are used for casting, it is necessary to employ various technological means, although often hazardous, in order to reduce the columnar character of the solidification and the texture associated therewith. Consequently, these "first generation" alloys should rather be considered as intended for wrought products, since suitable thermomechanical treatments can eliminate the defects and reduce the texture.

On the other hand, in the case of solidification in β form, the columnar character is less pronounced although the <100> axis of the β phase remains the preferred direction of crystal growth during solidification. However, on cooling after solidification, the crystals of the β phase, called the initial grains, are transformed into crystals of the α phase. This transformation, which occurs according to the so-called $(110)_\beta//(0001)_\alpha$ and $<1\bar{1}1>_\beta//<11\bar{2}0>_\alpha$ Burgers orientation relationship leads in theory to the formation of twelve α variants. On cooling further, the γ phase precipitates in lamellar form in each α variant. The resulting microstructure is characterized by the presence of numerous colonies (theoretically up to twelve orientation variants) within each initial β grain. Each of these colonies consists of many α platelets (or laths), these platelets (or laths) sometimes being bounded by borders of residual β phase. Finally, each platelet (or lath) exhibits the $\gamma+\alpha_2$ lamellar structure. Such a transformation sequence has the effect of minimizing the difficulties encountered with alloys solidifying in α form with a reduction in the frequency of solidification defects and a less pronounced texture.

Solidification in the β phase may be obtained for binary alloys sufficiently rich in Ti, as for example in the case of the $Ti_{60}Al_{40}$ composition, for which the Ti/Al atom ratio of 1.5 is very far from that of the equimolar composition $Ti_{50}Al_{50}$ which is equal to 1. However, alloys this rich in titanium are markedly heavier and less oxidation resistant than the equimolar alloy. Finally, after production, they exhibit a $\gamma+\alpha_2$ two-phase structure in which the volume fraction of the almost non-deformable $\alpha_2$ phase is excessively high, making them extremely brittle. It should be noted that the two-phase alloy of the $Ti_{52}Al_{48}$ composition of atom ratio equal to 1.08, which possesses the optimum ductility by virtue of a volume fraction of the $\alpha_2$ phase of about 10%, can only solidify in α form.

Attempts have therefore been made to find addition elements able to promote solidification in the β phase while at the same time maintaining the Ti/Al atom ratio close to the 52/48 optimum value, without this ratio exceeding the 1.16 value, and by minimizing the addition of refractory elements so as not to increase the weight of the alloys substantially. Surprisingly, it has been observed that rhenium is the most effective element in this regard, closely followed by tungsten. This is because an addition of about 2 atom. % of these elements in the $Ti_{52}Al_{48}$-based binary alloy is sufficient for the alloy to solidify almost entirely in the β phase, while the addition of approximately 5 atom. % is necessary for other elements. It has also turned out that the addition effect is cumulative. For example, if 1% of Re and 1% of W are added simultaneously, the alloy solidifies in the β form, whereas adding each of these elements to the indicated amount separately is not sufficient.

The aim of the invention is especially to provide an alloy of the kind defined in the introduction with an atomic composition lying within the field defined hereinbelow:

Ti: 48.5 to 52.5%
Al: 45.5 to 48.5%
Re: 0.5 to 2.5%
W: 0 to 2.0%
Re+W: 2.0 to 2.5%
Nb: 0 to 3.5%
Re+W+Nb: 2.0 to 5.5%
Si: 0 to 1.0%

The use of tungsten, as an element favoring solidification in β form, rather than rhenium alone, has an economic advantage because of the high cost of rhenium. The addition of niobium provides good oxidation resistance, as well as a good level of hot strength. Finally, the purpose of adding silicon is to obtain a beneficial effect on the mechanical properties in use, such as creep.

Optional characteristics of the alloy according to the invention, which are complementary or alternative, are mentioned hereinbelow:

It contains approximately 2 atom. % of Re+W.

It contains approximately from 1 to 2 atom. % of Re.

It contains approximately 3 atom. % of Nb.

It contains approximately from 0.2 to 0.8 atom. % of Si.

Its atomic formula is chosen from the following: $Ti_{50.6}Al_{46.6}Re_2Si_{0.8}$ (1) $Ti_{52}Al_{46}Re_1W_1$ (2) $Ti_{51.8}Al_{46}Re_1W_1Si_{0.2}$ (3) $Ti_{49}Al_{46}Nb_3Re_1W_1$ (4) $Ti_{48.8}Al_{46}Nb_3Re_1W_1Si_{0.2}$ (5).

It is suitable for forming, as it solidifies, a β phase of body-centered cubic structure.

The subject of the invention is also a casting produced from an alloy as defined hereinabove, comprising the juxtaposition of a multiplicity of colonies within each initial β grain, which colonies themselves comprise the juxtaposition of a multiplicity of platelets each formed by an alternating stack of lamellae of γ crystallographic structure and of layers of $\alpha_2$ crystallographic structure. The platelets of the same colony are oriented according to one of the 12 α variants defined by the Burgers relationship on the basis of said β grain, the platelets of two adjacent colonies being oriented as different variants.

BRIEF DESCRIPTION OF THE DRAWINGS

In the appended drawings and views, FIGS. 1 and 2 diagrammatically represent two successive steps in the solidification of an intermetallic alloy based on titanium aluminide.

FIG. 1 shows by way of example a cylindrical specimen 1 of an alloy in the process of cooling, in which columnar grains 2 of α crystallographic structure are forming. These grains are elongated along the c crystallographic direction which coincides with the direction of the temperature gradient indicated by the arrow F, that is to say the radial direction of the cylinder 1. FIG. 2 shows, on a larger scale, these same columnar grains 2 cooled further. Each of them contains lamellae 3 of γ crystallographic structure which are oriented perpendicular to the longitudinal direction of the grain and are separated from each other by layers 4 of $\alpha_2$ crystallographic structure.

FIG. 3 reveals the structure of such an alloy of the "first generation".

Figure 1:
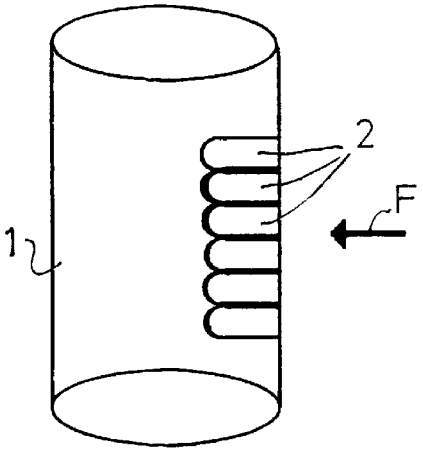
FIGS. 1 and 2 illustrate the α-phase cooling process described above.
Figure 2:
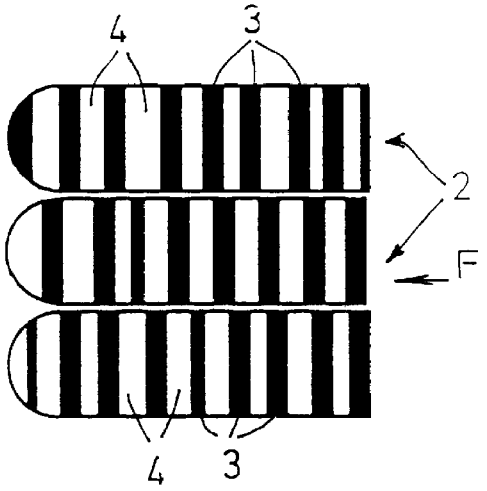
Figure 3:
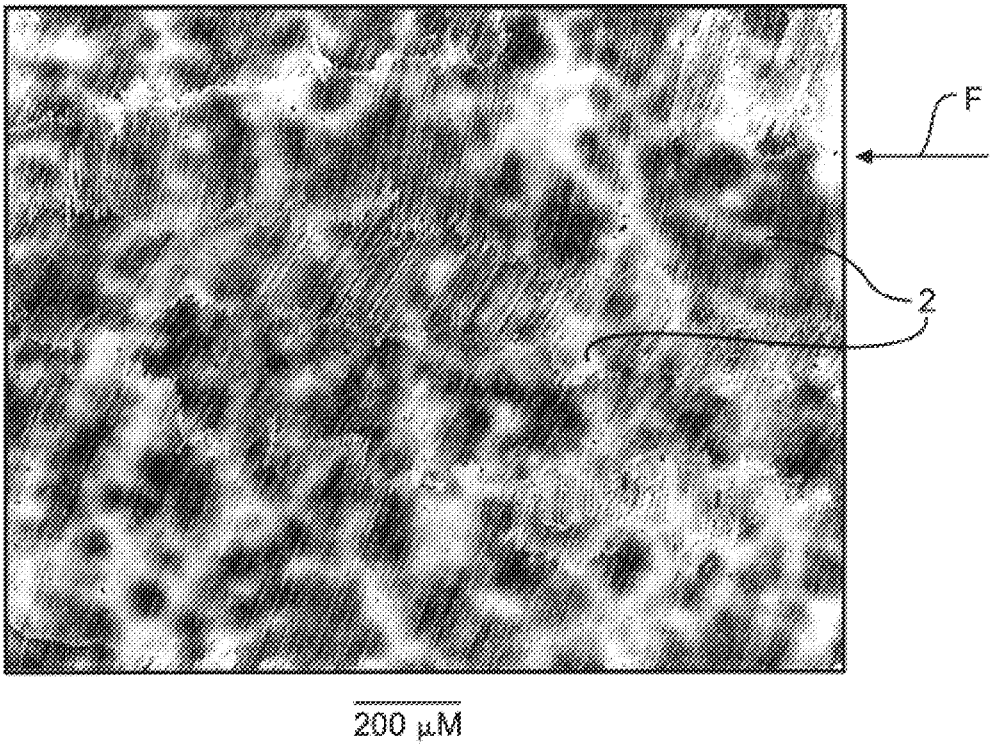
FIG. 3 is a sectional view of an alloy in accordance with that in FIG. 2.
Figure 4:
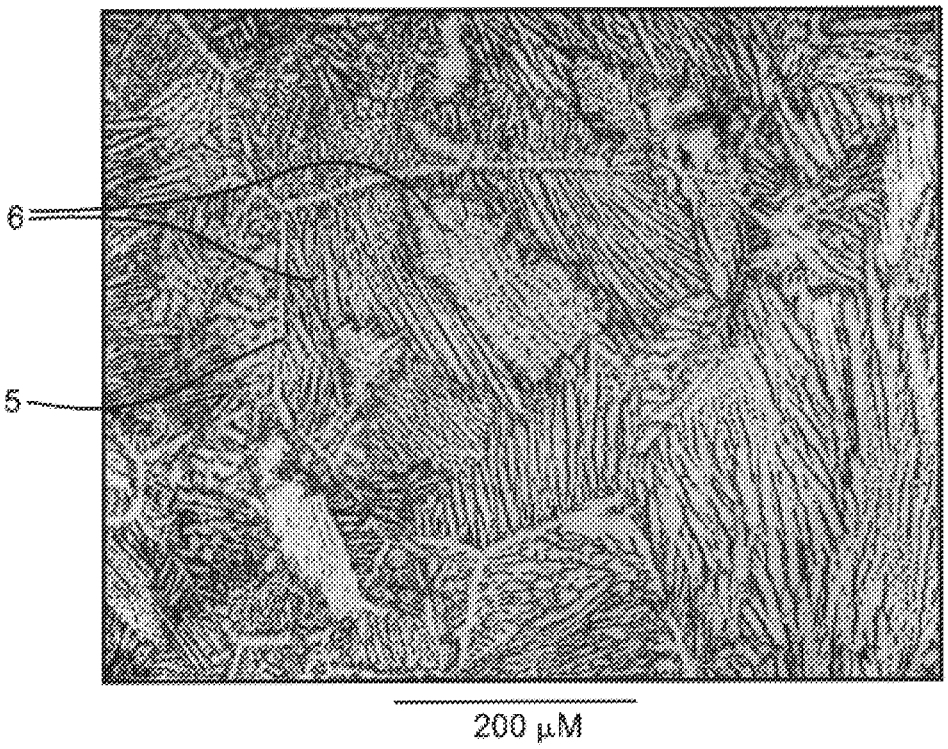
FIGS. 4 and 5 illustrate the structure of an alloy in accordance with the invention.

In the center of FIG. 4, a section of an alloy in accordance with the present invention, there may clearly be seen the boundary 5 of an initial β grain. In this grain, each colony 6 is revealed by the orientation of the platelets of which it is composed. Each orientation follows the Burgers relationship.

Figure 5:
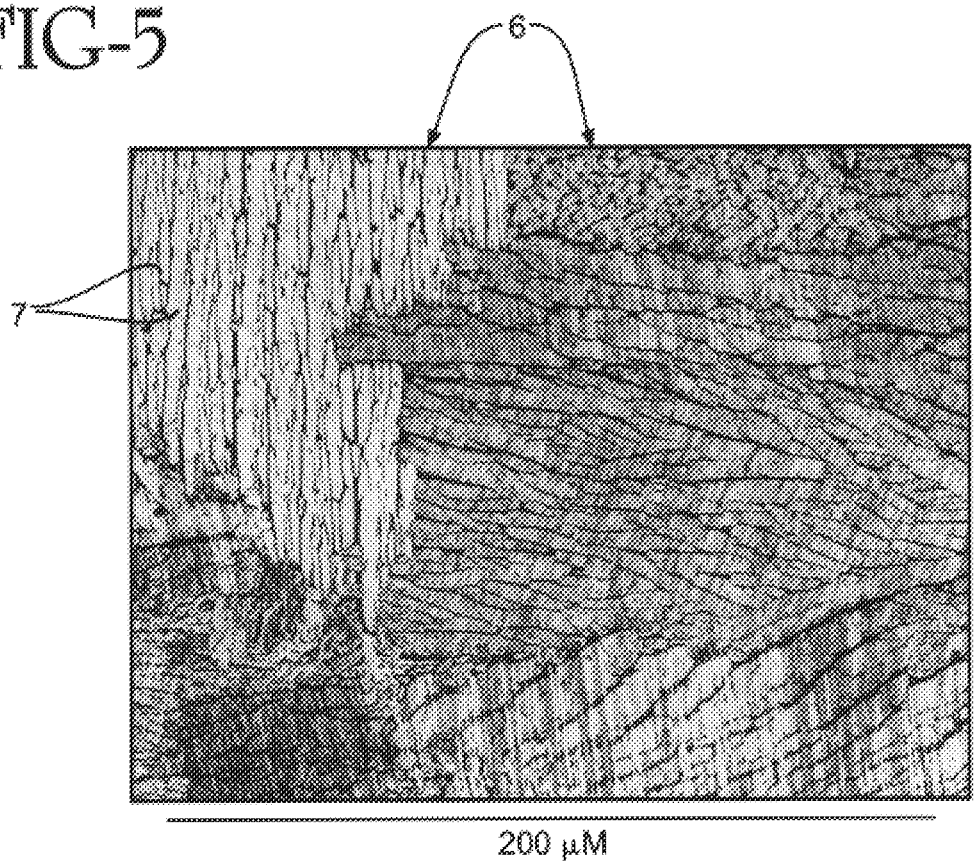

FIG. 5 is a section of the same alloy revealing, on the one hand, the orientation of the platelets 7 in each colony 6 and, on the other hand, the alternating stack of lamellae of γ crystallographic structure and of layers of $\alpha_2$ crystallographic structure.

The alloys according to the invention may be produced and processed in the same way as the known intermetallic alloys based on titanium aluminide, so that it is not necessary to provide particulars in this regard.

Tests have confirmed the superiority of the alloys according to the invention compared to the alloys of the prior art with regard to the high-temperature creep strength, which is a key factor in the industrial use of these materials.

The alloy of formula (1) above and the aforementioned alloy of formula $Ti_{48}Al_{48}Cr_2Nb_2$ were subjected to the same heat treatments, four hours at 1250° C. and then four hours at 900° C. After these treatments, both alloys exhibited similar tensile properties at 25° C., respectively 484 and 459 MPa for the yield strength and 1.4% and 0.9% for the elastic elongation or ductility. On the other hand, a creep strain of 0.5% at 800° C. under a stress of 180 MPa was obtained after 145 hours for the alloy according to the invention, compared to 5 hours for the known alloy. For this latter alloy, the hot creep strength could be improved by omitting the aforementioned heat treatments, but this would result in a collapse of the room-temperature ductility because of the poor castability associated with solidification in the α phase.

The alloys of formulae (1), (2) and (3) hereinabove, and an alloy of formula $Ti_{48}Al_{46}Nb_3W_1$, which is a prior art alloy that will be called Allison and which is regarded as being highly creep resistant, were subjected to a 750° C. creep test under a stress of 200 MPa. A strain of 0.5% was obtained after 625 hours, 212 hours, 740 hours and 56 hours, respectively, for the four alloys, i.e. durations from four to thirteen times longer for the alloys according to the invention compared to the alloy of the prior art.

We claim:

1. An intermetallic alloy based on titanium aluminide for the production of castings, wherein the alloy's atomic composition lies within the range as follows:

Ti: 48.5 to 52.5%

Al: 45.5 to 48.5%

Re: 0.5 to 2.5%

W: 0 to 2.0%

Re+W: 2.0 to 2.5%

Nb: 0 to 3.5%

Re+W+Nb: 2.0 to 5.5%

Si: 0 to 1.0%.

2. The alloy as claimed in claim 1, wherein the alloy contains about 2 atom. % of Re+W.

3. The alloy as claimed in claim 2, wherein the alloy contains about 1 to about 2 atom. % of Re.

4. The alloy as claimed in claim 1, wherein the alloy contains about 3 atom. % of Nb.

5. The alloy as claimed in claim 1, wherein the alloy contains about 0.2 to about 0.8 atom. % of Si.

6. The alloy as claimed in claim 1, wherein the alloys atomic composition is chosen from the following:

$Ti_{50.6}Al_{46.6}Re_2Si_{0.8}$ $Ti_{52}Al_{46}Re_1W_1$ $Ti_{51.8}Al_{46}Re_1W_1Si_{0.2}$ $Ti_{49}Al_{46}Nb_3Re_1W_1$ $Ti_{48.8}Al_{46}Nb_3Re_1W_1Si_{0.2}$.

7. The alloy as claimed in claim 1, wherein the alloy is suitable for forming, as it solidifies, a β phase of body-centered cubic structure.

8. A casting produced from an alloy as claimed in claim 7, comprising the juxtaposition of a multiplicity of colonies within each initial β grain, which colonies themselves comprise the juxtaposition of a multiplicity of platelets each formed by an alternating stack of lamellae of γ crystallographic structure and of layers of $\alpha_2$ crystallographic structure, the platelets of the same colony being oriented according to one of the 12 α variants defined by the Burgers relationship on the basis of said β grain, and the platelets of two adjacent colonies being oriented according to different variants.

* * * * *